United States Patent [19]

Harris

[11] 4,096,917

[45] Jun. 27, 1978

[54] EARTH DRILLING KNOBBY BIT

[76] Inventor: Jesse W. Harris, 527 Sonnet Dr., San Antonio, Tex. 78216

[21] Appl. No.: 766,589

[22] Filed: Feb. 8, 1977

Related U.S. Application Data

[63] Continuation of Ser. No. 617,959, Sep. 29, 1975, abandoned.

[51] Int. Cl.[2] ..... E21B 9/08; E21C 13/01; E21C 13/06

[52] U.S. Cl. ..... 175/228; 175/335; 175/339; 175/343; 175/410; 175/371; 175/417; 175/418

[58] Field of Search ..... 175/334, 335, 228, 343, 175/337, 371, 339, 340, 377, 345, 350, 417, 414, 418, 415, 410

[56] References Cited

U.S. PATENT DOCUMENTS

| | | | |
|---|---|---|---|
| 1,758,814 | 5/1930 | Zublin | 175/337 |
| 1,859,948 | 5/1932 | Zublin | 175/337 X |
| 1,906,056 | 4/1933 | Golish | 175/335 X |
| 1,945,240 | 1/1934 | Tupica | 175/371 X |
| 2,025,260 | 12/1935 | Zublin | 175/343 X |
| 2,101,007 | 11/1937 | Maher | 175/345 |
| 2,113,820 | 4/1938 | Zublin | 175/340 X |
| 3,357,507 | 12/1967 | Stewart | 175/418 X |
| 3,429,390 | 2/1969 | Bennett | 175/343 |
| 3,847,234 | 11/1974 | Schumacher, Jr. et al. | 175/228 |
| 3,918,538 | 11/1975 | Bender | 175/417 X |

*Primary Examiner*—Stephen J. Novosad
*Attorney, Agent, or Firm*—Gunn & Lee

[57] ABSTRACT

A partially solid head bit having a flow passage therethrough located at approximately the center of the bit is shown. The bit is designed for use in conjunction with a hammer action drilling apparatus. The flow passage extends through a shank of the bit to the bottom thereof. Surrounding the shank is a substantially hemispherical spiraled burr having an opening therethrough. The burr pushes against a shoulder of the shank during drilling. The mating surfaces of the shank and burr are lubricated by a suitable oil reservoir. On spirals of the burr and on the lower end of the shank are mounted hardened inserts for impacting against and breaking up the formation through which the bit may drill. The bottom of the shank may be even with, extend through, or be recessed with respect to the lower edge of the burr. The shank is angled a few degrees off the centerline of the drilling string to cause a wobbling action upon rotating the drill bit.

13 Claims, 6 Drawing Figures

EARTH DRILLING KNOBBY BIT

This is a continuation of application Ser. No. 617,959 filed Sept. 29, 1975, now abandoned.

BACKGROUND OF THIS INVENTION

This invention relates to earth boring drill bits and, more particularly, to an earth boring drill bit having a solid head shank portion and a surrounding, free rotating, burr portion. The present invention is designed for use with a rotary drilling apparatus, and is particularly suited to a rotary drilling apparatus utilizing percussion.

BRIEF DESCRIPTION OF THE PRIOR ART

In the early years of rotary drilling, the solid head bit was the typical bit used for cutting the earth formations. As the diameter of the hole to be drilled increased, the distance traveled by the outer edge of the solid head bit per revolution was equal to the diameter of the bit times $\pi$. Therefore, if a large diameter hole was being drilled, the outer edges of the bit would wear out before any appreciable wear would occur to the center portion of the bit. When percussion drilling was combined with rotary drilling, it was found that the drag characteristics on the solid head bit were much more damaging than the impact of the percussion tool. By use of hardened inserts in the solid heat bit, the percussion did not produce anywhere near the wear on the bit as did the drag.

The roller cone bit commonly used today reduces the problem of dragging the cutting edges across the formation and greatly increases the wear area of the bit. As the cones rotate with the rotation of the bit, a much greater surface area is exposed to the outwardly located cutting edges of the bit. A roller cone bit requires bearings and seals which are relatively fragile. A roller cone bit cannot take full advantage of the drilling rate increases available through percussion drilling because a roller cone bit cannot withstand high impact forces on the bearing and seal areas. Roller cone bits normally use a very high downweight and a rapid rotation to drill through the earth's formations.

Both the solid head and the roller cone bits use a stream of fluid delivered through drill pipe and the bit to remove the cuttings. The fluid entraps the cuttings and removes them by raising the cuttings up through the annulus of the hole with the drilling fluid. This prevents extra wear caused by regrinding of the cuttings. It is universally accepted that higher drilling fluid flow rates, including jets directing the fluid towards the bottom of the hole, improves chip clearing efficiency and adds significantly to the drilling rate.

Bennett (U.S. Pat. No. 3,429,390) shows a solid head bit connected off-center to the main string of drilling pipe to produce a wobbling effect while drilling through the earth's formations. However, in Bennett the hardened inserts around the outer edge of the bit are exposed to considerable wear due to drag.

Zublin (U.S. Pat. No. 2,025,260) shows another off-center cutter type bit for drilling through the earth's formations. In Zublin a cutter is located on an off-center shank, but the shank does not extend through the cutter. The cutter portion is free to rotate on the shank.

Stokes (U.S. Pat. No. 2,634,956) shows a boring apparatus having a drill pipe extending through the drilling bit. Again, the outer edges of the cutters would wear much faster than the inside cutters due to drag.

The solid head bits dominate the market for percussion drilling, especially when used for blast holes and water wells which usually do not require closely controlled hole gauge. Solid head bits can handle any formation encountered, plus there is relatively low cost per foot of hole drilled and moderate to high penetration rate. Roller cone bits are almost always used if any of the following conditions are encountered; (1) any fluid other than air is used for clearing the chips, (2) the hole being drilled is deeper than several hundred feet or (3) the hole size is 8 inches in diameter or larger. Since one of the foregoing requirements occurs in practically all oil and gas drilling, almost 100% of the bits used in the petroleum industry are of the roller cone type.

SUMMARY OF THE INVENTION

It is an object of the present invention to provide a bit that may be used in conjunction with percussion drilling without the disadvantages of the solid head bits or roller cone bits.

It is even another object of the present invention to provide a bit having reduced wear characteristics when drilling a large diameter hole, while simultaneously being suited for percussion drilling through hard formations.

It is another object of the present invention to provide an offset shank that extends through a burr portion to feed drilling fluid to the bottom of the hole being drilled. Hardened inserts on the end of the shank and the burr impact and cut through the earth formations.

It is yet another object of the present invention to provide a knobby type bit with a burr portion rotatably mounted on an offset shank. Spirals on the burr have hardened inserts to impact and cut through the earth's formations.

The knobby bit forming the present invention has a fluid flow passage extending down and out an offset shank portion to which a spiraled burr is attached. Around the flow passages at the bottom of the shank are located hardened inserts. Hardened inserts are also located on the raised spirals of the burr. As the bit turns due to rotation of the drilling pipe, the offset shank causes the bit to burrow into the formation. The raised spirals on the burr are arranged to oppose the direction of rotation of the burr to prevent "rifling" of the hole. Fluid being discharged in the bottom of the hole will clear the cuttings from around the bit and raise them up the annulus of the hole. Due to the burrowing effect of the bit and the center shank portion, none of the hardened inserts will be subject to very much drag which causes excessive wear. By using an impacting device above the bit, the hardened inserts will very readily break and chip away very hard earth formations. A very broad shoulder area is provided with lubrication to prevent excessive wear between the burr and the shank.

DESCRIPTION OF THE PREFERRED EMBODIMENT

Figure 1:
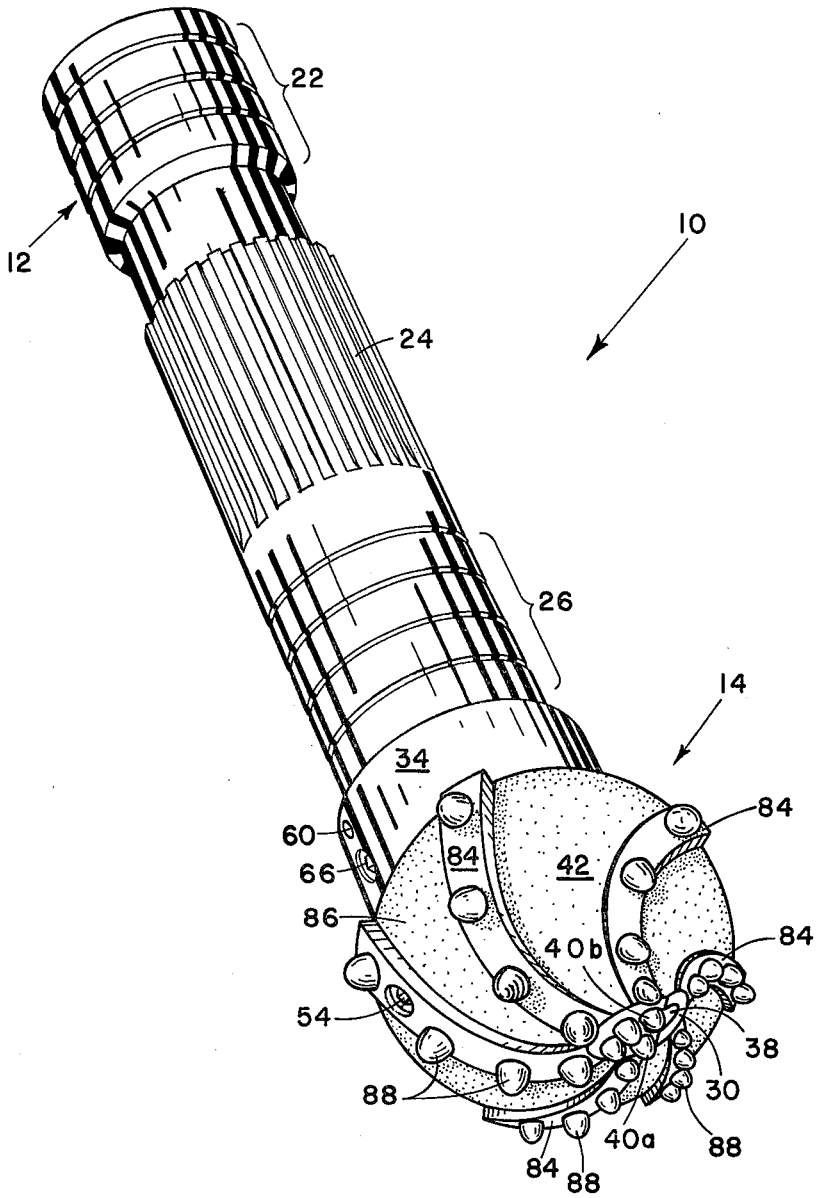
FIG. 1 is a lower perspective view of the preferred embodiment of the knobby bit.
Figure 2:
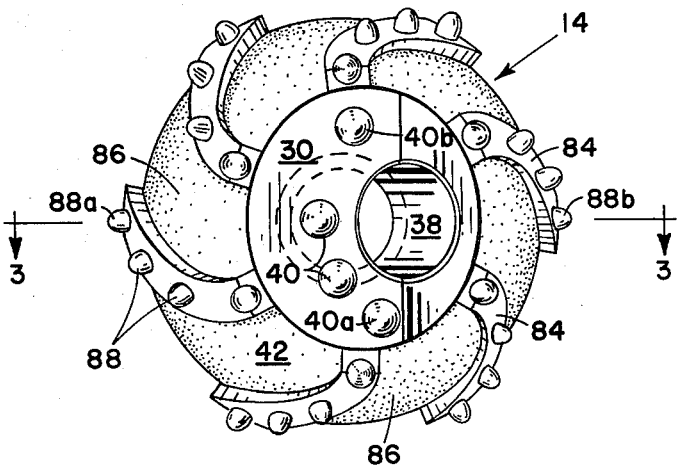
FIG. 2 is a bottom view of FIG. 1.
Figure 3:
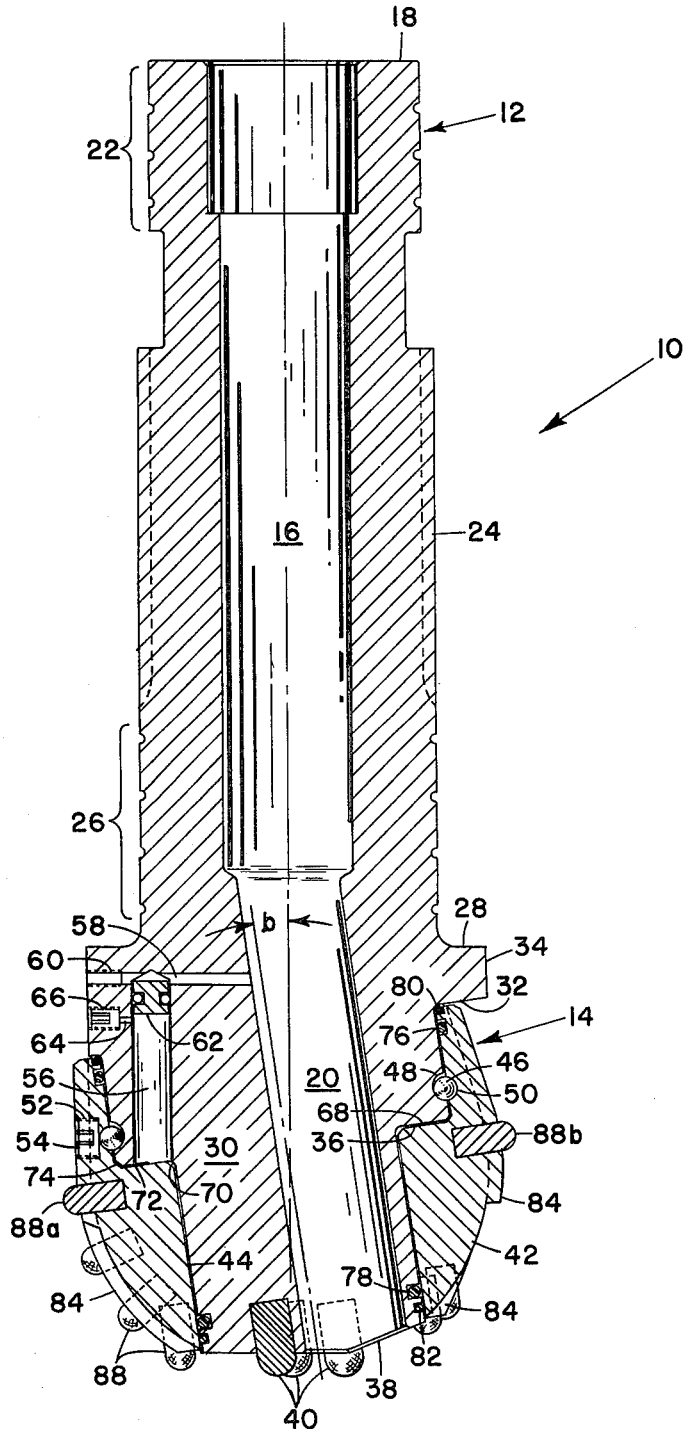
FIG. 3 is a cross sectional view of FIG. 2 along section lines 3—3.

Referring now to FIGS. 1, 2 and 3 in combination, there is shown a combined anvil-bit represented generally by the reference numeral 10. The upper portion is a typical anvil 12 used in percussion drilling and the lower portion being the unique knobby bit 14 embodying the present invention. The anvil 12 is described in more detail in U.S. Pat. No. 3,970,152 issued on July 20, 1976. The anvil 12 consists of a flow passage 16 that communicates from the impact surface 18 to the slanting passage 20. The upper portion of the anvil 12 has a seal area 22 for forming a sliding seal with a casing (not shown) in which the combined anvil-bit 10 is carried. Anvil 12 also has splines 24 for a typical spline connection with the casing (not shown). A second seal area 26 slideably seals between the combined anvil-bit 10 and a lower sub (not shown).

For applying a steady downward pressure on the bit 14, shoulder 28 of collar 34 abuts the bottom of the lower sub. Below the collar 34 is located a shank 30 that is offset from the center line of the anvil 12 by an angle "b". The slanting passage 20 is parallel to the center line of shank 30. The upper portion of shank 30 terminates into shoulder 32 which forms the lower portion of collar 34. Spaced downward along the center line of shank 30 from shoulder 32 is a weight bearing shoulder 36. At the bottom of shank 30 is an opening 38 for slanting passage 20. Also located at the bottom of shank 30 are hardened inserts 40 for impacting and cutting the earth's formations through which knobby bit 14 may be drilling. The hardened inserts 40 are typically made from tungsten carbide alloys.

Circumscribing the shank 30 is located a burr 42 that is free to rotate while drilling. The lower end of shank 30 extends through an opening 44 of burr 42. In assembling, the burr 42 simply slides over shank 30 with ball bearings 46 being inserted in opposing shank groove 48 and burr groove 50 through openings 52 in the burr. Opening 52 in the burr is then closed by any suitable means such as a set screw 54. The set screw 54 may be spot welded or held in by a pin to insure it will not come out.

A chamber 56 is provided in shank 30 with a small cross passage 58 connecting from the upper portion of chamber 56 to slanting passage 20. In actual manufacturing of the combined anvil-bit 10, chamber 56 will be drilled from the bottom with cross passage 58 being drilled from the side. Therefore, a suitable plug 60 should be used to close one end of cross passage 58. Inside of chamber 56 is located a piston 62. Below piston 62 is located a passage 64 which connects chamber 56 to the side of the combined anvil-bit 10. By removing set screw 66 from passage 64, it is possible to bleed air and completely charge chamber 56 with lubricant introduced through opening 52.

While drilling with the combined anvil-bit 10, a high pressure fluid will flow through flow passage 16 and slanting passage 20 with a portion of that high pressure fluid feeding through cross passage 58 to piston 62. This will force piston 62 against the oil in chamber 56 thereby maintaining a small pressure on the piston 62, which in turn maintains a small differential pressure on the seals 76 and 78. By slightly reaming a surface 70, a good flow of the lubricant from chamber 56 is provided to opening 44. To insure that the ball bearing 46 receives sufficient lubricant from chamber 56, a slight undercut 72 is provided in weight bearing shoulder, along with bevel 74, to allow the lubricant to reach ball bearing 46. To keep the lubricant between the burr 42 and shank 30, a seal 76 is located at the upper portion of the concentric mating surfaces and a seal 78 is located at the lower portion of the concentric mating surfaces. To protect seals 76 and 78, wipers 80 and 82 are located between seals 76 and 78, respectively, and the outside of the combined anvil-bit 10.

Extending from the bottom of burr 42 are located upwardly extending spirals 84. Between the spirals 84 are located grooves 86 through which the cuttings from the earth's formations may pass. In the spirals are located a series of hardened inserts 88 for impacting and cutting the earth's formations.

The burr 42, which is generally hemipherical in shape with opening 44 therethrough, has its center at the intersection of the center line for the anvil 12 and the center line for shank 30. The angle "b" between these two center lines should be a fairly small angle (approximately 8°). The applicant has found that the angle "b" can be varied between a range of 5° to 15° and still maintain the drillng effectiveness of the present invention. As the combined anvil-bit 10 turns during normal rotary drilling, the burr 42 will rotate in the direction opposite the direction of rotation of the anvil. To prevent "rifling" of the hole being drilled the spirals 84 are so spiralled that they oppose the burr 42 screwing itself into the formation. Rotation of the burr 42 opposite to the direction of rotation of the anvil 12 is caused from the high external friction on the lowermost corner of the burr 42. Of course, the rate of rotation of the burr will vary depending upon the friction and the formation being drilled; however, it is expected that the burr 42 will rotate at about 1/20th that of the anvil 12, but in the opposite direction. With the previously mentioned direction of spiral, the hardened inserts 82 will always cross the formations left by the leading inserts thereby preventing "rifling".

METHOD OF OPERATION

During normal drilling operations, a high pressure fluid will be flowing through flow passage 16 and slanting passage 20 before ejecting through opening 38 to remove the cuttings away from the knobby bit 14. The fluid will flow upward around and over the hardened inserts 40 and 88 to remove the cuttings at the maximum possible rate. The cuttings will be raised in the annulus of the hole by the flow of the drilling fluid. As the knobby bit 14 turns, the end of shank 30 operates in the same manner as a solid head bit with the hardened inserts 40 impacting and cutting the earth's formations. The pressurized fluid ejected through opening 38 immediately removes the cuttings therefrom.

The hardened inserts **40*a* and 40*b* which are located on the outer edges of the bottom of shank 30 rotate around a circular path. The circular path covered by the hardened inserts 40*a* and 40*b* overlap the area where the lowermost point of the shank 30 and the burr 42 come together. This overlapping by the hardened inserts 40*a* and 40*b* helps protect seal 78 from damage by the cuttings. As the shank 30 rotates, the burr 42 also impacts against the side and outer edges of the hole being drilled. However, because the burr 42 is free to rotate, the hardened inserts 88 are not subject to the drag previously experienced by solid head bits. Since the rotation of the burr 42 is much slower than the rotation of shank 30 the outermost inserts 88*a* and 88*b*** will not be subject to the same amount of drag as the outermost inserts of a typical solid head bit. In fact, the knobby bit 14 tends to burrow itself into the formation with the inserts 40 on the end of shank 30 being used to fracture any hard formations.

Because the weight bearing shoulders 36 and 68 are properly lubricated and have sufficient strength by increased shoulder area over previous roller cone bits, very little wear will occur between the burr 42 and the shank 30. On prior tri-cone (roller cone) type bits, there was a tremendous problem with shank wear and damage when drilling with percussion devices. Almost no appreciable stress is felt on ball bearing 46 which is used to hold the burr 42 on shank 30. As the burr 42 turns on shank 30 lubricant from chamber 56 will be constantly applied to the mating surfaces of the shank 30 and burr 42 to prevent excessive wear. The seals 76 and 78 will keep the lubricant from leaking from the knobby bit 14. Periodically, additional lubricant may have to be added to chamber 56 by removing set screw 54 and replenishing the lubricant.

When drilling in soft formations the cuttings will be gouged up through grooves 86 of spirals 84. However, the rotating action which causes the burr 42 to rock back and forth will clear any portion of the cuttings from the hole and prevent rifling.

FIRST ALTERNATIVE EMBODIMENT

Figure 4:
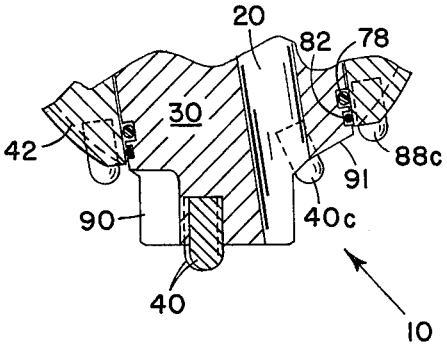
FIG. 4 is a partial sectional view of a first alternative embodiment of FIG. 1.

Referring now to FIG. 4 there is shown an alternative embodiment in a partial sectional view wherein the shank 30 extends considerably below the burr 42. A bottom portion 90 of shank 30 is located along the center line of anvil 12 to drill a pilot hole for the remaining portion of the knobby bit. A shoulder 91 is formed by the portion of shank 30 that terminates at the bottom of the burr 42. The hardened inserts 40 fracture the formation with additional inserts **40*c* clearing the area around the pilot hole. The hardened insert 40*c* protects the seal 78 from damage by the cuttings. The hardened inserts 88*c* of the burr 42 overlaps the area to which the seal 78 may be exposed to cuttings thereby further insuring against damage to the seal 78. The remaining portions of the combined anvil bit 10 operate in the same manner as the preferred embodiment shown in FIGS. 1–3**.

SECOND ALTERNATIVE EMBODIMENT

Figure 5:
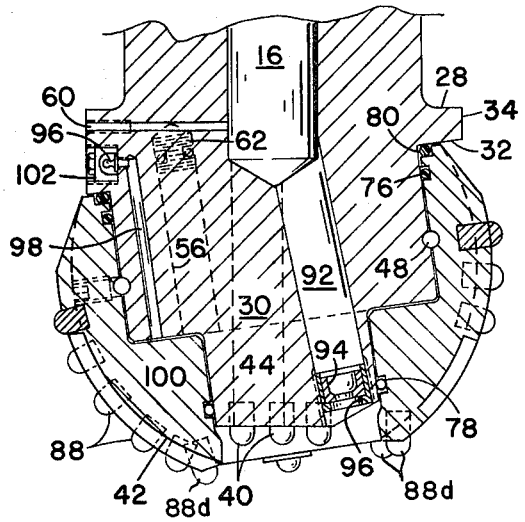
FIG. 5 is a partial sectional view of a second alternative embodiment of FIG. 1.
Figure 6:
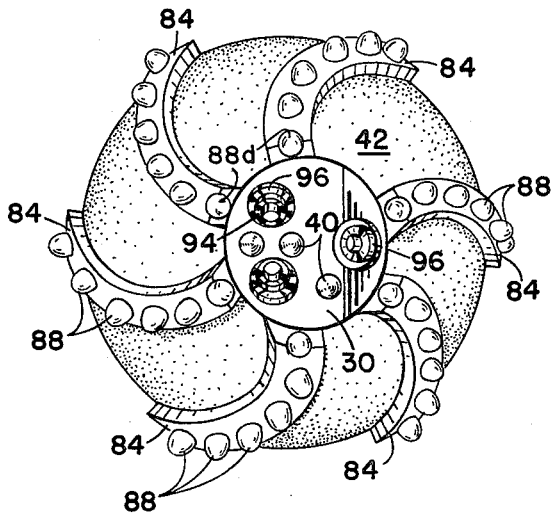
FIG. 6 is a bottom view of FIG. 5.

Referring now to FIGS. 5 and 6 in combination, there is shown a second alternative embodiment wherein the shank 30 is recessed inside of the opening 44 of burr 42. Hardened insert **88*d* of the burr 42 are the leading inserts used to fracture the formation. They also extend over the seal 78 to protect it from the cuttings. Three flow passages 92 that connect to flow passage 16 provide a high volume of jetted fluid to the bottom of the hole for rapid removal of cuttings. The three flow passages 92 insure a more equal distribution and higher flow rate of fluid to the bottom of the hole. Depending upon the particular requirements of the individual situation, a nozzle 94 may be located in retainer 96 at the bottom of flow passages 92. Any particular size nozzle 94 desired may be used depending upon the particular situation. By using a nozzle 94, the fluid can be ejected at a high velocity against the formation through which the knobby bit is drilling. Location of the three flow passages 92 in shank 30 can best be seen in FIG. 6**.

In the second alternative embodiment, chamber 56 may be refilled with lubricant through grease fitting 96. Grease flows into bore 98 which connects to chamber 56 by means of slot 100. The grease fitting 96 is protected by means of cap nut 102.

I claim:

1. A percussion drill bit having an upper end comprising an anvil surface, a lower end comprising a cutting bit, and a generally cylindrical side surface adapted to be received for slidable longitudinal movement in the casing of a fluid operated percussion hammer, said cutting bit having a central shank portion offset relative to the longitudinal axis of said drill bit and terminating in a cutting end surface, and a rotatable cutting head secured on said shank portion for rotary motion thereon.

2. A percussion bit according to claim 1 in which said cutting head has a cutting surface adjacent to and contiguous with said cutting end surface of said central shank portion.

3. A percussion bit according to claim 1 wherein said cutting head is a generally hemispherically shaped burr.

4. A percussion bit according to claim 3 wherein said burr includes raised surfaces spiraling upward from the bottom to the top thereof, said spiraling surfaces being spiraled opposite to the normal direction of rotation of said burr, and said raised spiraling surfaces having hardened inserts therein.

5. A percussion bit according to claim 3 wherein the center line of said shank portion intersects the center line of said cylindrical portion at approximately the center of said hemispherically shaped burr.

6. A percussion bit according to claim 1 wherein said shank portion cutting end surface extends below said cutting head to pilot the hole being drilled.

7. A percussion bit according to claim 1 wherein said shank portion cutting end surface is recessed in said cutting head.

8. A percussion bit according to claim 1 wherein said bit has a longitudinal flow passage extending therethrough and through said shank portion and including a plurality of ports in said cutting end surface of said shank portion to conduct fluid for removal of cuttings during operation thereof.

9. A percussion bit according to claim 1 wherein said shank portion has a center line intersecting the center line of said cylindrical side surface at an angle of about five to fifteen degrees.

10. A percussion bit according to claim 1 wherein said cutting head and said shank portion have mating weight bearing surfaces to withstand downward forces on said drilling bit, means for applying lubricant to said bearing surfaces, means for retaining said cutting head on said shank portion during rotation thereof, and a plurality of hardened inserts positioned around the cutting surface of said cutting head and said shank portion cutting surface.

11. A percussion bit according to claim 10 wherein said mating weight bearing surfaces comprise a first shoulder on said shank portion and a second shoulder in said cutting head, said lubricating means including a reservoir of lubricant communicating with said first and second shoulders, and sealing means between said cutting head and said shank portion to maintain lubricant therebetween.

12. A percussion bit according to claim 11 wherein said reservoir comprises a chamber connected to said first and second shoulder, piston means in said chamber above said lubricant, means to apply force to said piston means to feed said lubricant, and means for refilling said chamber with lubricant.

13. A percussion bit according to claim 10 wherein said cutting head and said shank portion have mating peripheral grooves therein forming a bearing race, and a plurality of ball bearings positioned and secured in said race functioning to provide rotary bearing surfaces and to hold said cutting head on said shank portion.

* * * * *